United States Patent [19]

Niemeyer et al.

[11] 4,420,662

[45] Dec. 13, 1983

[54] COMPRESSED-GAS CIRCUIT BREAKER

[75] Inventors: Lutz Niemeyer; Klaus Ragaller, both of Schweiz, Switzerland

[73] Assignee: BBC Brown, Boveri & Company Ltd., Switzerland

[21] Appl. No.: 316,518

[22] Filed: Oct. 29, 1981

[30] Foreign Application Priority Data

Oct. 31, 1980 [CH] Switzerland ..... 8102/80

[51] Int. Cl.[3] ..... H01H 33/70; H01H 33/10

[52] U.S. Cl. ..... 200/148 R; 200/148 A; 200/149 B

[58] Field of Search ..... 200/149 B, 148 A, 148 R

[56] References Cited

U.S. PATENT DOCUMENTS

| | | | |
|---|---|---|---|
| 3,639,712 | 2/1972 | Balmat et al. | 200/148 A |
| 3,665,134 | 5/1972 | Fischer | 200/148 A |
| 4,256,940 | 3/1981 | Kii | 200/149 B |

FOREIGN PATENT DOCUMENTS

| | | | |
|---|---|---|---|
| 2039240 | 4/1971 | Fed. Rep. of Germany | 200/148 A |

*Primary Examiner*—Robert S. Macon
*Attorney, Agent, or Firm*—Ostrolenk, Faber, Gerb & Soffen

[57] ABSTRACT

A compressed-gas circuit breaker possesses two contact members (1, 2), which move relative to one another, and a nozzle (7), which is made of dielectric material and is attached to a first (2) member of the two contact members. The constriction (8) of the nozzle (7) which is made of dielectric material, separates a compression-space (9) from an expansion-space (15), and the compressed gas used for extinguishing the arc which occurs on operating the circuit breaker flows through this constriction. An insert (13), designed in the shape of an annulus, is provided at the nozzle constriction (8). The design of the nozzle (7), which is made of dielectric material, is such that it can be exposed to a high thermal loading in the region of its constriction, while, at the same time, high voltages can be held in the breaker-gap, without the occurrence of instances of arcing-over. This object is achieved by arranging the insert (13) to be electrically isolated with respect to the two contact members (1, 2) the insert exhibits a first capacitance with respect to the first contact member (2) and a second capacitance with respect to the second contact member (1). The magnitudes of the capacitances are chosen, by suitable arrangement and dimensioning of the insert (13), so that the electric field in the region of the nozzle constriction (8) is displaced at least partially from the surface of the nozzle, into the compression-space (9) and into the expansion-space (15).

9 Claims, 3 Drawing Figures

COMPRESSED-GAS CIRCUIT BREAKER

BACKGROUND OF THE INVENTION

This invention relates to a compressed-gas circuit breaker having two contact members which move relative to one another, a nozzle which is made of dielectric material and is attached to a first of the two contacts members and in which compressed gas is caused to flow through the constriction of the nozzle from a compression space into an expansion space, the expanding gas being used for extinguishing the arc which occurs when the circuit breaker is operated.

A circuit breaker of this type has been disclosed in German Auslegeschrift No. 2,039,240. In this circuit breaker, the nozzle, which is made of dielectric material and is attached to the first contact member, possesses a graphite part in the region of the nozzle constriction. This graphite part is designed in the shape of an annulus and is electrically connected, via a current collector, to the main contact of the second contact member. This main contact is designed as a tubular sleeve. The graphite part is provided in order to receive the root of the arc which is struck between the contact members as the circuit is broken, this arc-root being located on the second contact member and its reception, by the graphite part, occurring as soon as the distance between the contact members reaches a predetermined value. Since the arc thereafter burns between the nozzle and the contact member attached thereto, the distance between the roots of the arc remains constant, the intention being, by this means, to avoid unnecessary elongation of the arc and to increase the circuit-breaking capacity.

In the case of this arrangement, however, the electric field, which is generated at the breaker-gap by the transient recovery voltage, after the arc has been extinguished in the zero-current condition, is forced into that portion of the compression space which is situated between the nozzle and the first contact member and which, despite being subject to a high pressure nevertheless has a narrow configuration and is subject to high thermal loading. Moreover, the extension of the arc on to the nozzle gives rise to an extremely high surface temperature. Both phenomena lead to impairment of the dielectric hardening of the breaker-gap.

The object of the invention is to produce a circuit breaker of this generic type, in which the reception of an arc-root on the nozzle surface is avoided, and in which the nozzle can be exposed to a high thermal loading in the region of its constriction, without the occurrence of instances of arcing-over via the thermally loaded nozzle surface when high voltages are applied to the breaker-gap.

This object is achieved by providing at least one annular insert at the nozzle constriction. This insert is electrically isolated with respect to the two contact members and exhibits a first capacitance with respect to the first contact member and a second capacitance with respect to the second contact member. The magnitudes of the capacitance are chosen, by suitable arrangement and dimensioning of the insert, so that the electric field, which is formed when a voltage exists between the contact members, is displaced in the region of the nozzle constriction, at least partially from the surface of the nozzle into the compression space and into the expansion space. The circuit breaker according to the invention is distinguished by the fact that, in contrast to comparable known breakers, the circuit breaking capacity is increased by simple means; that is, the electric field generated by the transient recovery voltage is displaced from the region of the nozzle constriction, at least partially into the spaces situated in front of and behind the nozzle constriction, as a result of which the stress-loading in the constriction region of the nozzle is reduced following the extinguishing of the arc.

It is additionally possible, depending on the design configuration of the compressed-gas circuit breaker, to relocate a greater or lesser portion of the electric field into the space in front of or behind the nozzle constriction.

If the insert of the compressed-gas circuit breaker according to the invention is configured so that the insert is comprised of a material having a dielectric constant greater than 5 extension of the arc at the nozzle is avoided in a particularly effective manner.

It is advantageous, in order also to be able to use inserts of a material which does not exhibit an overly high burn-off resistance with respect to the arc associated with the breaking of the circuit, to embed the insert in the dielectric material of the nozzle. This embedding may be effected so that the insert contains diffusely distributed powder which is comprised of a conductive material or has a dielectric constant greater than 5. Thus, local field-peaks on the surface of the nozzle (which is made of dielectric material) are avoided. Direct contact between the arc and the embedded material is also avoided while, a smooth transition of the electric field intensity is achieved at the ends of the region of the nozzle constriction.

BRIEF DESCRIPTION OF THE DRAWINGS

In the text which follows, exemplary embodiments of the invention are illustrated, in a simplified form, with the aid of the drawing, in which.

DETAILED DESCRIPTION OF THE PREFERRED EMBODIMENTS

Figure 1:
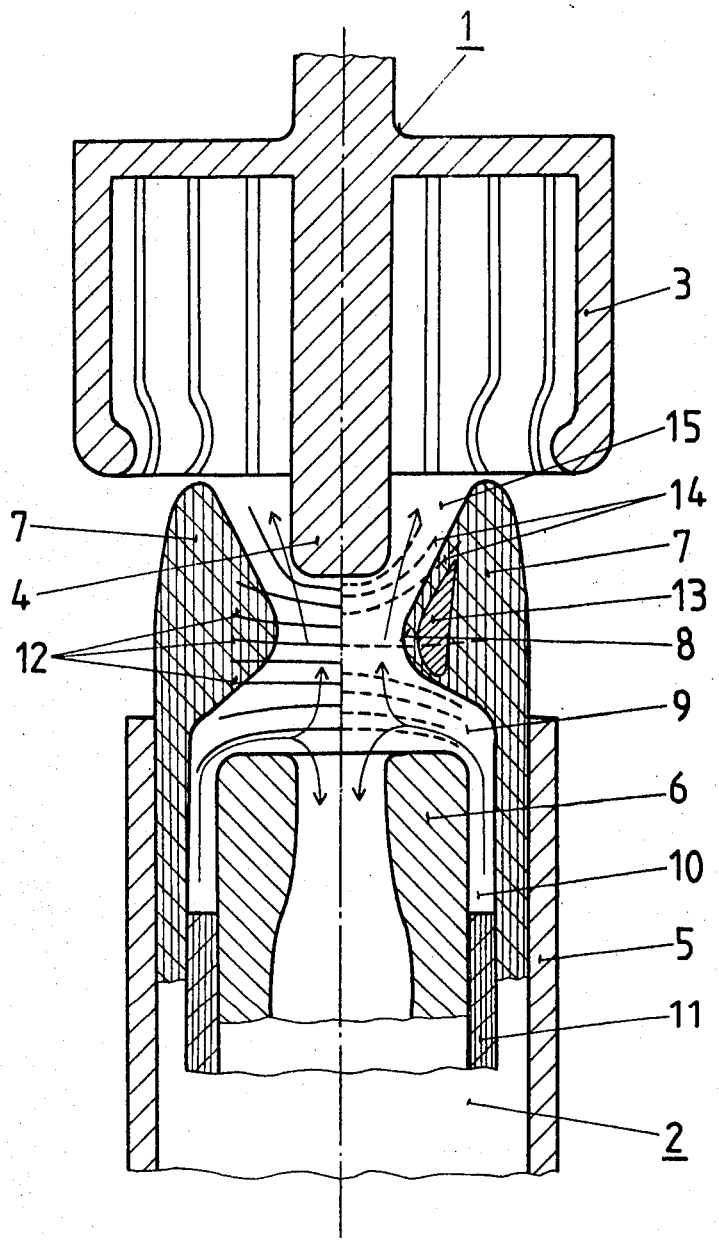
FIG. 1 is a view, in cross section, of a contact arrangement of a compressed-gas circuit breaker according to the invention.

In all Figures, identical parts are marked with identical reference numbers. FIG. 1 illustrates the contact arrangement of a compressed-gas circuit breaker. This arrangement, which is rotationally symmetric, possesses a moving contact member 1 and a stationary contact member 2. The moving contact member is provided with a constant-current contact 3 and an arcing contact 4. The arcing contact 4, which is designed as a pin, is located on the axis of rotation of the contact arrangement and is secured at a distance from the constant-current contact 3, the latter being provided with contact fingers arranged in a basket shape (not marked in the Figure). In the closed "on" position of the circuit breaker, not illustrated, the arcing contact 4 of the moving contact member 1 engages into the arcing contact 6, of hollow design, of the stationary contact member 2. The contact fingers of the moving constant-current contact 3 are pressed against the outer surface of the constant-current contact 5 of the stationary contact member 2, the constant-current contact 5 being of tubular design. A nozzle 7, made of dielectric material, is secured to the stationary contact member 2 in a manner such that, below its constriction 8, it forms, in conjunction with the arcing contact 6, the boundaries of a blast-passage 9, through which—is indicated by arrows—compressed gas is blown from a compression device 10 which possesses a piston 11. Piston 11 is non-positively coupled to the moving contact 1 and gas is blown into the breaker-gap situated between the arcing contacts 4 and 6. This compressed gas expands behind the constriction 8 of the nozzle 7 and behind the constriction of the hollow arching contact 6, which is designed in the shape of a nozzle. During this expansion, the gas which has been heated and loaded with electrically charged particles in the breaker-gap is intensively and thoroughly mixed with electrically neutral, cool compressed gas.

On the left-hand side of FIG. 1, a nozzle 7, made of dielectric material, is illustrated, this type of nozzle being generally used in compressed-gas circuit breakers. In this area, equipotential surfaces of the electric field are marked 12, these surfaces being generated by the transient recovery voltage during the process of switching-off a current, following the extinguishing of the arc in the zero-current condition. It can be recognized that the equipotential surfaces 12 are particularly closely spaced at the surface of the nozzle constriction 8, so that a high electric field intensity accordingly prevails at that position. Since, however, this surface has recently been subjected to high thermal loading, caused by the arc occurring on breaking the circuit, instances of electrical arcing-over can occur in this region.

The right-hand side of FIG. 1, illustrates how this problem is solved according to the invention. Here, an insert, embedded in the dielectric material of the nozzle 7, is marked 13. It can be recognized that the equipotential surfaces 14 in the region 8 of the constriction of the nozzle 7 made of dielectric material, drawn in with broken lines, are pulled widely apart fron one another at the surface of the nozzle. This pulling-apart is a consequence of the arrangement and dimensioning, according to the invention, of the insert 13. The insert is, of course, arranged so that it is electrically isolated with respect to the two contact members 1 and 2, and additionally possesses a first capacitance with respect to the stationary contact member 2, and a second capacitance with respect to the moving contact member 1. In this design, the magnitudes of the capacitances are chosen, by suitable arrangement and dimensioning of the insert, in such a way that the electric field in the region of the nozzle constriction 8 is displaced, at least partially, from the surface of the nozzle into the blast-passage 9 and into the expansion space 15 situated behind the nozzle constriction. In the illustrative embodiment represented in FIG. 1, the insert exhibits a dielectric constant of approximately 20, as a result of which, in the case of a suitable arrangement and dimensioning of the insert 13, there occurs a reduction in the electrical field intensity at the nozzle constriction 8 of approximately 70%, compared to the electrical field intensity in the surface region of the constriction of a geometrically comparable nozzle made of dielectric material, without an insert.

An insert containing a material having a dielectric constant of approximately 5 enables the field intensity to be reduced by approximately 30% in the region of the constriction, as a result of which considerable improvements in the circuit breaking capacity of the compressed-gas circuit breaker immediately occur.

It can be advantageous to dimension the insert 13 in such a way that the capacitance between the insert and the stationary contact member 2 exceeds the capacitance between the insert 13 and the moving contact member 1. This design is advantageous, above all, because the greatest portion of the holding voltage applied between the contact members 1 and 2 falls away within the blast-passage 9. This condition is advantageous, insofar as the gas is present, at that point, under the comparatively high compressive pressure, and a particularly high dielectric strength is thereby guaranteed.

As material for the insert 13, arc-resistant conductive materials, such as, for example, graphite, or Teflon which has been filled with a conductive material, or materials having a dielectric constant greater than 5, such as, for example, barium titanate, or plastic which has been blended with barium titanate, are primarily considered, the weight-ratio barium titanate/plastic preferably being between 0.5 and 5%.

Figure 2:
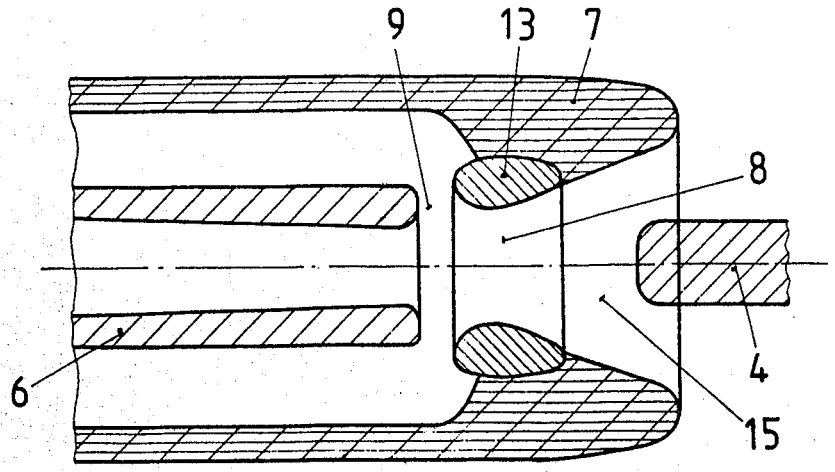
FIG. 2 is a view, in cross section, of an embodiment of the compressed-gas circuit breaker according to the invention, in which a conductive insert is provided in the region of the nozzle constriction.

FIG. 2 shows an arrangement, in which the conductive insert 13 consists of a material which resists burning-off, and is arranged so that it forms the nozzle constriction 8. In this case, the voltage loading during the process of breaking the circuit is initially located, while the separation of the contact members is small, essentially at the blast-passage 9, but shifts to an increasing extent into the expansion space 15 as the distance between the two contact members 1 and 2 increases. Instead of a conductive material which is resistant to burning-off, it is also possible to use a material which is resistant to burning-off and has a dielectric constant in excess of 5, such as, for example, Teflon with a barium titanate filling.

Figure 3:
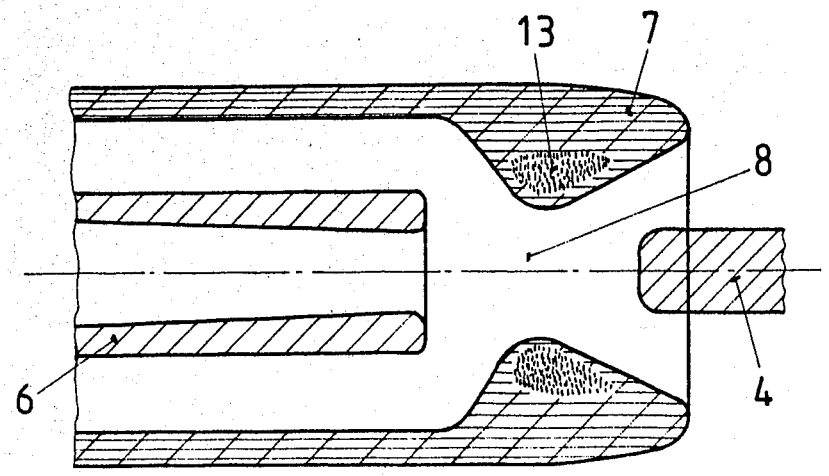
FIG. 3 is a view, in cross section, of a further embodiment of the circuit breaker according to the invention, in the case of which a powder, made of a conductive material, or of a material having a dielectric constant in excess of 5, is diffusely distributed, as the insert, in the dielectric material of the nozzle.

A further embodiment of the subject of the invention is illustrated in FIG. 3. In this embodiment, a conductive material, or a material having a dielectric constant in excess of 5, is provided as the insert 13, this material being diffusely distributed in the dielectric material of the nozzle. This conductive material is arranged in the nozzle 7 (which is made of dielectric material) preferably inhomogeneously and with a smoothly varying density-distribution, as a result of which local field-peaks are largely avoided. Direct contact of the embedded material with the arc cannot accordingly take place. An insert of this type is preferably produced by embedding the conductive material, or the material having a high dielectric constant, in the form of powder in the nozzle material, which is similarly in the form of powder, followed by sintering. In such a composite, the proportion of the powder introduced, expressed as a percentage, is between 0.5 and 20%, depending on the conductivity or the dielectric constant, and in the case of materials having a high conductivity and/or a high dielectric constant, is preferably between 0.5 and 5%.

We claim:

1. Compressed-gas circuit breaker comprising two contact members which move relative to one another, a nozzle which is made of dielectric material and is attached to a first member of the two contact members, means for causing compressed gas to flow through the constriction of the nozzle, from a compression-space into an expansion-space, the gas being used for extinguishing the arc which occurs on operating the circuit breaker, and at least one annular insert at the nozzle constriction, the insert being arranged so that it is electrically isolated with respect to the two contact members and is capable of assuming a potential unrelated to the potential of either of said two contact members and exhibits a first capacitance with respect to the first contact member and a second capacitance with respect to the second contact member, magnitudes of the capacitances being chosen, by suitable arrangement and dimensioning of the insert, so that an electric field, and is formed on applying a voltage between the contact members, is displaced, in the region of the nozzle construction, at least partially from the surface of the nozzle, into the compression-space and into the expansion-space.

2. Compressed-gas circuit breaker as claimed in claim 1, wherein the first capacitance is smaller than the second capacitance.

3. Compressed-gas circuit breaker as claimed in claims 1 or 2, wherein the insert contains a material having a dielectric constant exceeding 5.

4. Compressed-gas circuit breaker as claimed in claim 3, wherein the material comprises barium titanate.

5. Compressed-gas circuit breaker as claimed in claims 1 or 2, wherein the insert is embedded in the dielectric material of the nozzle.

6. Compressed-gas circuit breaker as claimed in claim 5, wherein the insert comprises conductive material which is diffusely distributed.

7. Compressed-gas circuit breaker as claimed in claim 5 wherein the insert comprises a material which is diffusely distributed and has a dielectric constant exceeding 5.

8. Compressed-gas circuit breaker as claimed in claim 3, wherein the insert is embedded in the dielectric material of the nozzle.

9. Compressed-gas circuit breaker as claimed in claim 4, where in the insert is embedded in the dielectric material of a nozzle.

* * * * *